United States Patent [19]

Wendler

[11] Patent Number: 4,941,389

[45] Date of Patent: Jul. 17, 1990

[54] ELECTRONIC PICKUP WITH MOUNTING ASSEMBLY FOR A HOLLOW BODIED MUSICAL INSTRUMENT

[76] Inventor: David C. Wendler, 1302 E. 19th, Lawrence, Kans. 66044

[21] Appl. No.: 234,487

[22] Filed: Aug. 22, 1988

[51] Int. Cl.[5] ..... G10H 3/14; G10H 3/00; G10H 3/18

[52] U.S. Cl. ..... 84/727; 84/723; 84/725; 84/726; 84/743

[58] Field of Search ..... 84/1.14–1.16, 84/1.04, 1.06, 1.01, DIG. 12, 723, 725, 726, 727, 728, 743; 336/110, 130, 131; 335/230, 234

[56] References Cited

U.S. PATENT DOCUMENTS

| | | | |
|---|---|---|---|
| 2,020,842 | 11/1935 | Loar | 84/1.15 |
| 3,657,461 | 4/1972 | Freeman | 84/1.15 |
| 3,711,619 | 1/1973 | Jones et al. | 84/1.15 |
| 4,050,341 | 9/1977 | Underwood | 84/1.16 X |
| 4,168,646 | 9/1979 | May | 84/1.14 |
| 4,242,937 | 1/1981 | Pozar | 84/1.15 |
| 4,269,103 | 5/1981 | Underwood | 84/1.14 X |
| 4,351,216 | 9/1982 | Hamm | 84/1.15 |
| 4,351,217 | 9/1982 | Wechter | 84/1.16 |
| 4,519,287 | 5/1985 | Naruse | 84/1.16 |
| 4,570,522 | 2/1986 | May | 84/1.14 |
| 4,647,892 | 3/1987 | Hewitt | 336/110 X |
| 4,809,578 | 3/1989 | Lace, Jr. | 84/1.15 |

FOREIGN PATENT DOCUMENTS

| | | | |
|---|---|---|---|
| 436911 | 10/1935 | United Kingdom | 336/130 |

*Primary Examiner*—A. T. Grimley
*Assistant Examiner*—Matthew S. Smith
*Attorney, Agent, or Firm*—Litman, McMahon & Brown

[57] ABSTRACT

An electrical pickup includes a coil with windings terminating at winding ends. A coil mounting assembly includes telescopically innerconnected inner and outer tubes, the outer tube being adapted for mounting in the interior of a musical instrument body and the inner tube mounting the coil. A magnet assembly includes a magnet with opposite poles and a lens with a concavity for receiving the magnet. The lens is adapted for mounting on an interior of a panel of the instrument body in a position where a pole of the magnet is aligned with the coil. Electrical leads extend from the coil winding ends and may be connected to an amplifier.

16 Claims, 1 Drawing Sheet

Fig. 1.
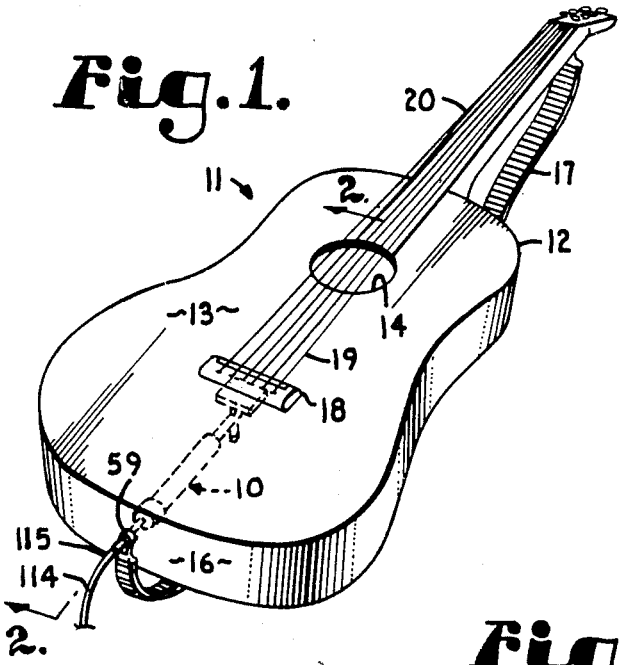
Fig. 6.
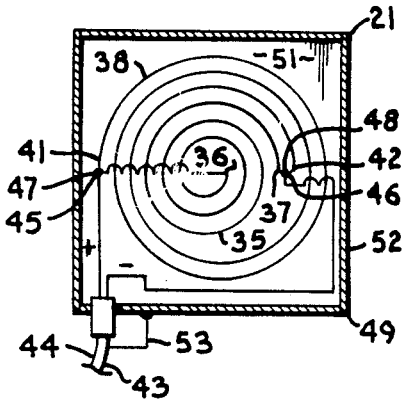
Fig. 2.
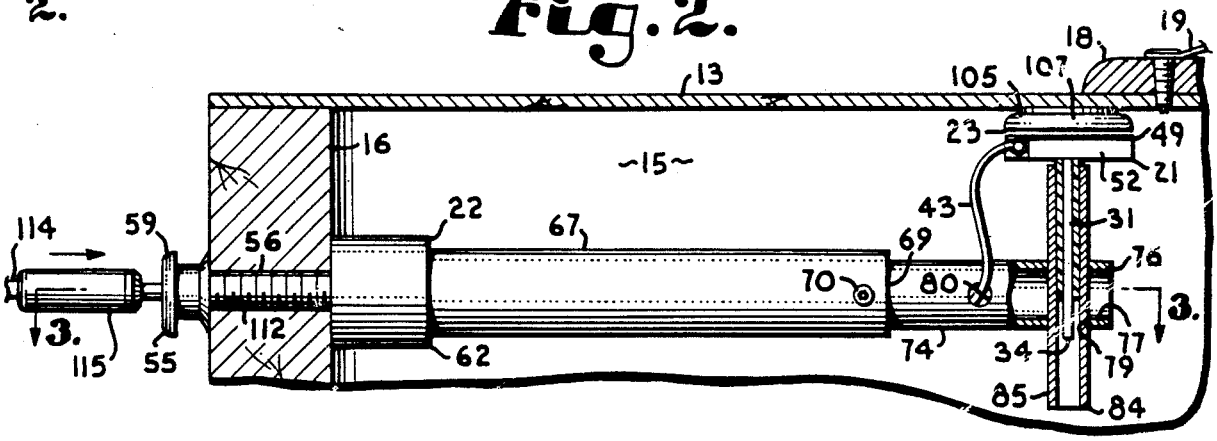
Fig. 3.
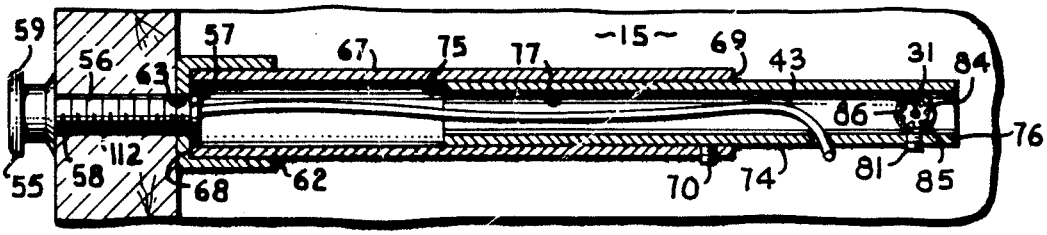
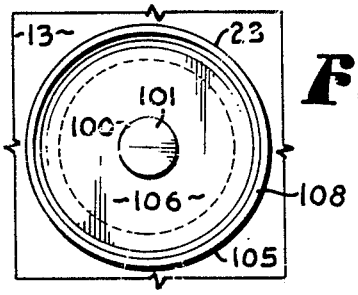
Fig. 5.
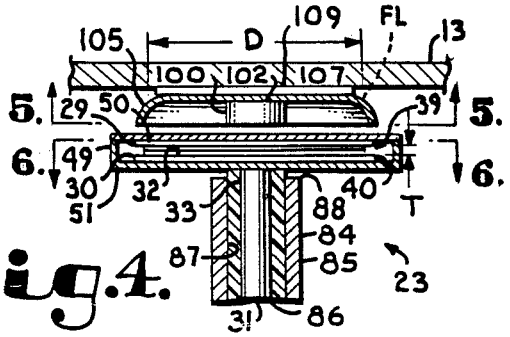
Fig. 4.

ELECTRONIC PICKUP WITH MOUNTING ASSEMBLY FOR A HOLLOW BODIED MUSICAL INSTRUMENT

BACKGROUND OF THE INVENTION

1. Field of the Invention.

The present invention relates generally to electrical pickups, more particularly to a musical instrument pickup and specifically to a pickup for mounting within the interior of a hollow-body instrument such as a guitar.

2. Description of the Prior Art.

Transducers for converting acoustic energy to electrical energy are well known and a variety of different types have heretofore been proposed to meet the requirements of particular applications. For amplifying the sounds of musical instruments, microphones and pickups connected to power amplifiers are commonly used.

Acoustic stringed instruments generally include hollow bodies enclosed by a panel, referred to as a "soundboard" to which the strings are attached. Sound holes are often provided in the soundboard to emit the sound from the interior of the hollow instrument body. The configuration, material, sound hole location, string material and other characteristics of the musical instrument all affect the tonal qualities of the sound.

Electric stringed instruments, on the other hand, often have solid bodies. Electric guitars comprise a common type of electric, stringed musical instrument and include ferromagnetic strings. Pickups are mounted in proximity to the strings of electric guitars and generally include coils and magnets which move relative to each other in synchronization with the vibration of the strings when the instrument is played. The pickup converts the vibration of the strings to alternating current electrical signals which can be amplified.

Electric guitars are often designed with solid bodies that are acoustically inert so that a relatively "pure" signal is produced. The sound produced by amplified, solid-body electric guitars differs considerably from the sound produced by acoustic guitars, and musicians tend to select guitars appropriate for their musical styles and the desired sound characteristics. For example, acoustic guitars are generally thought of as having more "resonant" tonal qualities, whereas notes and chords played on electric guitars can be sustained longer by the pickup and amplification circuitry.

Hybrid types of guitars include hollow-body electric guitars and acoustic guitars fitted with various types of microphones and pickups. For performing, recording and playing with other musicians, acoustic guitar players often require amplification of their instruments. To this end, acoustic guitars are often "miked" by placing a microphone in proximity to the instrument body. The microphone is connected to an amplifier. A disadvantage with this arrangement is that the instrument body must remain in proximity to the microphone. Many musicians prefer not to be so restricted while performing. Another possible disadvantage is that the microphone may pick up extraneous sounds in addition to those of the acoustic guitar.

The prior art pickups for acoustic guitars, on the other hand, provide more mobility for the performer but usually at a sacrifice of resonant tonal quality. Many prior art acoustic guitars with pickups tend to sound "tinny", "bassy" or too much like an electric guitar. In general they fail to provide the resonant tonal qualities preferred by acoustic guitar players.

Heretofore there has not been available an electrical pickup which faithfully reproduces the tonal qualities of hollow-body instruments with the advantages and features of the present invention.

SUMMARY OF THE INVENTION

In the practice of the present invention, an electrical pickup is provided for a stringed musical instrument having a hollow body with an interior at least partially enclosed by a soundboard panel mounting the strings. The pickup includes a coil assembly with a winding having opposite ends. A coil mounting assembly is adapted for mounting the coil within the instrument body interior and includes telescopically connected inner and outer tubes. The outer tube is mounted on the guitar body and the inner tube is connected to the coil assembly. A magnet assembly includes a magnet with opposite poles and a lens with a concavity receiving the magnet. The lens is adapted for mounting on an inside surface of the soundboard panel with a pole of the magnet aligned with the coil. Electrical leads are connected to the coil winding ends and are adapted for connection to a power amplifier.

OBJECTS AND ADVANTAGES

The objects and advantages of the present invention include: providing a pickup for a musical instrument; providing such a pickup for a hollow-body, acoustic musical instrument; providing such a pickup with good tonal qualities; providing such a pickup which transduces acoustic energy to electrical energy; providing such a pickup which is adapted for connection to an amplifier for faithfully amplifying the sound of an acoustic instrument; providing such a pickup which, when coupled to an amplifier, provides an amplified sound with the resonant tonal characteristics of the acoustic instrument; providing such a pickup which is well adapted to the needs of performing and recording musicians; providing such a pickup which is relatively unobtrusive when mounted in a hollow-body instrument; providing such a pickup which is relatively easy to install in a hollow-body instrument; providing such a pickup which may be installed with minimal modifications to a hollow-body instrument; providing such a pickup which is adjustable to achieve optimum performance; providing such a pickup which is adaptable for classical, steel-string, jumbo and other types of acoustic guitars; providing such a pickup with a pair of coils wound concentrically in opposite directions; providing such a pickup with a pair of coil leads and a separate ground shield for a balanced system; providing such a pickup which, when installed n an acoustic guitar, is not likely to subject a musician playing the guitar to electrical shock; and providing such a pickup which is economical to manufacture, efficient in operation, capable of a long operating life and particularly well adapted for the proposed uses thereof.

Other objects and advantages of this invention will become apparent from the following description taken in conjunction with the accompanying drawings wherein are set forth, by way of illustration and example, certain embodiments of this invention.

The drawings constitute a part of this specification and include exemplary embodiments of the present invention and illustrate various objects and features thereof.

BRIEF DESCRIPTION OF THE DRAWINGS

FIG. 1 is a perspective view of an acoustic guitar with a pickup embodying the present invention shown in phantom.

FIG. 2 is an enlarged, fragmentary, sectional view of the guitar taken generally along line 2—2 in FIG. 1 and showing a side elevation of the pickup.

FIG. 3 is a horizontal, cross-sectional view of the pickup taken generally along line 3—3 in FIG. 2.

FIG. 4 is an enlarged, fragmentary, vertical, cross-sectional view of the pickup, particularly showing coil and magnet assemblies thereof.

FIG. 5 is a horizontal, cross-sectional view of the pickup taken generally along line 5—5 in FIG. 4 and particularly showing a bottom plan view of a magnet assembly.

FIG. 6 is a horizontal cross-sectional view of the pickup taken generally along line 6—6 in FIG. 4 and particularly showing a schematic diagram of the coil windings.

DETAILED DESCRIPTION OF THE PREFERRED EMBODIMENTS

As required, detailed embodiments of the present invention are disclosed herein; however, it is to be understood that the disclosed embodiments are merely exemplary of the invention, which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Without limitation, vertical orientational references (e.g. up, down, top, bottom, etc.) apply to the pickup and guitar as oriented in FIG. 1).

I. Introduction and Environment

Referring to the drawings in more detail, the reference numeral 10 generally designates a pickup embodying the present invention which may be mounted substantially within a hollow-body musical instrument, such as an acoustic guitar 11. The guitar 11 includes a hollow body 12 with a soundboard panel 13 having sound hole 14 and partially enclosing a body interior 15. The body includes a butt block 16 to which a strap 17 may be attached at one end. A bridge 18 is mounted on an exterior surface of the soundboard panel 13 between the sound hole 14 and the butt block 16. Strings (e.g. numbering six for a guitar) 19 are each attached at one end to the bridge 18. A neck 20 extends from the body 12 and mounts the other ends of the strings 19. The other end of the strap 17 may be attached to the neck 20 as shown or to the body 12.

The acoustic guitar 11 described thus far is generally of a type which is commonly available in different sizes, styles, price ranges, etc.

The pickup 10 generally comprises a coil assembly 21, a coil mounting assembly 22 and a magnet assembly 23.

II. Coil Assembly

The coil assembly 21 includes a bobbin 28 with parallel, spaced, upper and lower bobbin disks 29, 30 each concentrically mounted on a bobbin center post 31 with upper and lower ends 33, 34. The upper bobbin disk 29 is mounted adjacent to the bobbin center post upper end 33, and the lower bobbin disk 30 is positioned slightly below and in close proximity to the bobbin center post upper end 33. An annular winding groove 32 encircles the bobbin center post between the disks 29, 30. The upper and lower bobbin disks 29, 30 include perimeters 39, 40 respectively.

An inner coil winding 35 is wound concentrically around the bobbin center post 31 within the winding groove 32 in a first direction, e.g. clockwise as shown in FIG. 6, and includes first and second ends 36, 37. An outer coil winding 38 is wound concentrically around the inner winding 35 in a second direction, e.g. counterclockwise as shown in FIG. 6, and is located between the bobbin disk perimeters 39, 40 and the inner winding 35. The outer winding 38 includes first and second ends 41, 42. The windings 35, 38 may comprise copper wire, for example, forty-two gauge or finer.

The inner and outer windings 35, 38 are substantially equal in length, and their respective first ends 36, 41 and second ends 37, 42 are connected together at first and second winding terminals 45, 46. The windings 35, 38 may be wound to achieve a desired impedence, for example about three hundred and forty ohms each for a total, parallel-connected impedence of one hundred and seventy ohms. The impedence of the coil windings 35, 38 may be adjusted by varying their respective lengths, by using different wire gauges and materials, etc. The bobbin center post 31 may comprise a nonferromagnetic material, such as brass.

The inner and outer windings 35, 38 collectively have a thickness "T" (FIG. 4) equal to the spacing between the bobbin disks 29, 30 and a diameter "D" which may be slightly less than the diameter of the disks 29, 30. The winding diameter D is preferably at least four times greater than the winding thickness T.

A coil housing 49 may comprise a nonferromagnetic material, such as brass sheet metal, and may include a square top 50, a square bottom 51 and generally rectangular sides 52. The bobbin center post 31 extends through the center of the housing bottom 51 in proximity to the post upper end 33. The disks 29, 30 and the windings 35, 38 are sandwiched between the coil housing top and bottom 50, 51.

The coil assemby 21 includes a grounded, shielded cable 43 with first and second (e.g. positive and negative) leads 47, 48. A grounding shield 44 of the cable 43 is electrically connected to the coil housing 49 by a jumper 53. The leads 47, 48 are electrically connected to the first and second winding terminals 45, 46 respectively.

III. Coil Mounting Assembly

The coil mounting assembly 22 includes a grounded, three-conductor (i.e. positive, negative and ground) jack subassembly 55 including an externally-threaded tube 56 with inner and outer ends 57, 58. The tube 56 threadably receives a bezel nut 59. An end cap 62 includes a coaxial, internally-threaded receiver 63 threadably receiving the jack subassembly tube 56. An outer, tubular guide member 67 includes an outer end 68 mounting the end cap 62 and an open, inner end 69 with a set screw 70.

An inner tubular member 74 is telescopically received in the outer guide member 67 and includes proximate and distal ends 75, 76. A variable-length section of the inner tubular member 74 adjacent to its proximate end 75 is slidably and telescopically received in a section of the outer guide member 67 adjacent to its inner end 69. The inner tubular member 74 includes a coaxial bore 77 extending between its opposite ends 75, 76.

In proximity to its distal end 76, the inner tubular member 74 includes a passage 79 extending therethrough and intersecting the inner tubular member bore 77 at approximately right angles. A cable opening 80 is formed in the inner tubular member 74 and may be located slightly outwardly from the vertical passage 79. A set screw 81 extends into the inner, tubular member 74 at approximately the intersection of its bore 77 and its vertical passage 79.

A coil mounting column subassembly 84 includes a sleeve 85 slidably received in the vertical passage 79 whereby it extends vertically and is approximately perpendicular to the telescopic members 67, 74. The sleeve 85 may comprise a nonferromagnetic metal such as brass. Within the sleeve 85 a column insulator 86 is positioned and includes a vertically extending bore 87. The column insulator 86 is fluted (FIG. 3) and preferably comprises a resilient, elastomeric material, e.g. rubber, which is compressed slightly to fit snugly within the sleeve 85. The coil mounting column subassembly includes upper and lower ends 88, 89. The column insulator bore 87 receives the coil post 31 and mounts the coil housing 49 adjacent to the coil mounting column subassembly upper end 88.

The cable 43 extends from the coil assembly 21, through the cable opening 80, through the coil mounting assembly telescopic members 67, 74 and is electrically connected to the jack subassembly 65.

IV. Magnet Assembly

The magnet assembly 23 comprises a magnet 100 with first and second (e.g. north and south) poles 101, 102. The magnet 100 may comprise, for example, a lightweight magnetic material such as neodymium ferrite or samarium cobalt. A circular lens 105 comprising a ferrous material is provided with a lower, inner concave surface 106; an upper, outer convex surface 107; and a downwardly, inwardly projecting rim 108. The magnet 100 is attached (for example, by adhesive) with a pole 101 or 102 against the lower, inner surface 106 substantially in the center of the lens 105. Although the second (south) pole 102 is shown against the concave lower surface 106, the orientation of the magnet 100 could be reversed, which of course would reverse the polarity of the magnet assembly 23. The lens 105 is attached (for example, by adhesive 109) to an inside surface of the guitar soundboard panel 13 so that its rim 108 and the magnet first (north) pole 101 face downwardly into the guitar body interior 15. The lens 105 is preferably located in a central area of the soundboard panel 13, for example below the edge of the bridge 18 located closest to the guitar butt block 16.

The magnet assembly lens 105 functions to mount the magnet 100 and also to direct the flux to its upper (south) pole 102 from the outer coil winding 38. The approximate orientation of the flux from the magnet 100 is represented by the flux lines FL. As shown in FIG. 4, the lens rim 108 is positioned approximately above the outer perimeter of the coil outer winding 38 whereby the lens 105 has a diameter approximately equal to the diameter D of the coil outer winding 38.

V. Installation

The pickup 10 of the present invention is designed for relatively easy installation in a hollow-body musical instrument, such as the acoustic guitar designated 11. In particular, the pickup 10 is designed for installation with a minimum of modifications to the instrument. Most acoustic guitars include a knob screwed into the butt block for attachment of a guitar strap. A process of installing the pickup 10 in the guitar 11 includes the step of removing the knob (not shown) from the butt block 16. Using the screw hole (not shown) for the knob as a guide, a jack receiver 112 is drilled through the butt block 16. The jack receiver 112 may have a diameter approximate equal to the diameter of the jack subassembly tube 56.

The guitar strings 19 are either loosened or removed to provide access to the body interior 15 through the sound hole 14. The magnet assembly 23 may be mounted next, and the coil and coil mounting assemblies 21, 22 may be utilized to properly position the magnet assembly 23 within the body interior 15. The coil mounting assembly 22 is adjusted to an appropriate length whereby the coil assembly 21 will be located below a central area of the soundboard panel 13 (FIG. 2). The length of the coil mounting assembly 22 is adjustable by telescopically sliding the members 67, 74 thereof with respect to each other. The telescopic members 67, 74 may be secured with respect to each other at a desired length with the set screw 70.

The coil mounting column subassembly 84 is normally adjusted with respect to the inner tubular member 74 so that the coil assembly 21 is positioned slightly below and in spaced relation from the magnet assembly 23. However, for purposes of mounting the magnet assembly 23, the coil mounting column subassembly 84 may be slightly raised. The magnet assembly 23 may then be temporarily attached to the coil assembly 21, for example, with two-sided tape. The adhesive 109 may then be applied to the upper (outer) convex surface of the lens 105.

The temporary assemblage comprising the coil assembly 21, the coil mounting assembly 22 and the magnet assembly 23 may then be inserted in the body interior 15 through the sound hole 14, and the jack subassembly tube 56 inserted through the jack receiver 112 and secured by the bezel nut 59. In this temporary configuration, the magnet assembly 23 will be pressed against the inner surface of the soundboard panel 13 whereby the adhesive 109 can be given sufficient time to properly set up.

Having served its purpose of temporarily attaching the magnet assembly 23 to the coil assembly 21, the two-sided tape may then be removed and the magnet assembly 23 will remain more or less permanently attached. The coil and coil mounting assemblies 21, 22 may then be withdrawn from the body interior 15 through the sound hole 14. The coil mounting column subassembly 84 may then be repositioned on the inner tubular member 74 to achieve the proper spacing between the coil and magnet assemblies 21, 23. The spacing between the coil and magnet assemblies 21, 23 greatly affects the flux linkage therebetween, which in turn affects the sound reproduction with the pickup 10. Generally, greater bass response is achieved by placing the coil and magnet assemblies 21, 23 closer together, and greater treble response is attained when they are further apart. The adjustability features of the present invention permit a musician to experiment with different settings to obtain optimum performance.

VI. Operation

With forty-two gauge copper wire comprising the windings 35, 38, and with a coil diameter-to-thickness ratio (D/T FIG. 4) of at least of four-to-one, the pickup 10 may be configured for a relatively low impedence of under six hundred ohms. For electrical instrument amplifiers, impedence values under six hundred ohms are considered relatively low. If the pickup 10 is to be connected to an amplifier with a higher input impedence rating, an impedence matching device, such as a transformer, may be provided. The pickup 10 of the present invention may be connected to an amplifier (not shown) by a cable 114 with a three-conductor (i.e. positive, negative and ground) plug 115 adapted for insertion in the jack subassembly 55 as shown in FIG. 2.

The pickup 10 described above provides balanced power output for a balanced system wherein a pair of coil leads 47, 48 are provided and are electrically isolated from a grounding shield 44. Thus, the amplifier power is isolated from the coil leads 47, 48, which are shielded by the shield 44 from interference.

Unlike many electric guitars wherein the metal strings are grounded to the amplifier, a musician playing an instrument equipped with the pickup 10 of the present invention would not normally be in contact with any electrically conductive parts of the system. Thus, the likelihood of a musician receiving an electrical shock while playing an instrument equipped with the pickup 10 of the present invention may be accordingly reduced.

The balanced coil assembly 21 of the present invention, with its substantially equal-length windings attached to separate leads and the windings being wound in opposite directions for interaction with the opposite magnet poles 101, 102, provides what is sometimes referred to as a "Humbucking" effect. The concentric, oppositely-wound coils thus link flux with the opposite magnet poles 101, 102. The result is a relatively true, faithful reproduction of the musical instrument sound.

When the guitar 11 is played, the strings 19 vibrate at their respective harmonic frequencies or pitches, which vibrations are transmitted to the soundboard panel 13. The magnet assembly 23 thus vibrates with resect to the coil assembly 21. The flux linkage between the magnet 100 and the coil windings 35, 38 changes as the distance therebetween changes, whereby current flow is induced in the windings 35, 38. The current is conducted through the windings 35, 38; through the terminals 45, 46; through the leads 47, 48; through the jack subassembly 55 to the plug 115; and thence to an amplifier (not shown) or other device.

The guitar strap 17 may be attached to the bezel nut 59. The column insulator 86 of the coil mounting column subassembly 84 tends to isolate the coil assembly 21 from its mounting assembly 22 and tends to dampen unwanted vibrations.

It is to be understood that while certain forms of the present invention have been illustrated and described herein, it is not to be limited to the specific forms or arrangement of parts described and shown.

For example, a two-conductor system with a coil having a single winding could be employed with the pickup of the present invention.

What is claimed and desired to be secured by Letters Patent is as follows:

1. A pickup for a stringed musical instrument having a hollow body with an interior at least partially enclosed by a soundboard panel mounting the musical instrument strings, which comprises:

(a) a coil including:
  (1) a bobbin including a concentric center post;
  (2) an inner winding wound concentrically in a first direction on said bobbin;
  (3) an outer winding wound concentrically on said bobbin around said inner winding;
(4) said windings being of substantially equal length and each having first and second ends;
(5) said first and second ends of said inner and outer windings connected at first and second winding terminals;
(b) a coil mounting assembly including:
  (1) a male threaded tube extending through an opening in said instrument body and threadably mounting a nut on the exterior of said instrument body;
  (2) an end plug having a female-threaded bore threadably receiving said threaded tube;
  (3) an outer, tubular guide member having a bore communicating with said end plug bore and having proximate and distal ends, said guide member proximate end mounting said end plug;
  (4) an inner, reciprocative tube telescopically received in said outer guide tube bore and having proximate and distal ends, said proximate end being received within said outer guide tube bore and said distal end having an end receiver extending transversely through said inner tube in proximity to said inner tube distal end, said inner tube having a coaxial bore intersecting said end receiver and a side opening;
  (5) a column sleeve having proximate and distal ends and a bore extending therebetween, said sleeve being slidably received in said inner tube end receiver;
  (6) a resilient, elastomeric, fluted column insulator received in said sleeve bore, said column insulator having an insulator bore coaxial with said sleeve bore and receiving said bobbin post;
  (7) a nonferromagnetic coil housing mounted on said bobbin post and enclosing said coil;
  (8) an inner tube set screw threadably received in said outer tube in proximity to said outer tube distal end, said inner tube set screw being adapted to impinge upon said inner tube within said outer tube bore; and
  (9) a sleeve set screw threadably received in said inner tube and adapted to impinge upon said sleeve within said inner tube bore;
(c) a magnet having first and second poles;
(d) a ferromagnetic flux lens having an inner side with a concavity and an outer side, said lens terminating at a peripheral rim at said lens inner side, said rim being positioned in proximity to said second coil;
(e) said lens outer side being secured to an interior surface of said soundboard in axial alignment with said coil;
(f) said magnet being mounted at least partly within said concavity with said magnet first pole in closely-spaced proximity to said coil and said magnet second pole being attached to said lens inner side; and
(g) an electrical lead comprising first and second insulated wires connected to said coil first and second terminals respectively and conductive shielding connected to said coil housing, said lead extending through said inner tube side opening, through a portion of said inner tube, through said outer tube bore and terminating at female connection jack means at said threaded tube.

2. A pickup for a musical instrument having a hollow body with an interior at least partly enclosed by a panel, which comprises:
(a) an electrical coil with a center, multiple turns and first and second ending points;
(b) a magnet with first and second poles;
(c) first mounting means for attachment to said body and for mounting one of said coil and said magnet within said body interior;
(d) second mounting means for attachment to said musical instrument panel and mounting the other of said coil and said magnet within said body interior with said coil and said magnet flux linked;
(e) said first pole of said magnet being oriented toward and flux-linked with a center of said coil;
(f) flux direction means for directing flux from said second pole of said magnet towards said coil around said coil center; and
(g) said first mounting means including:
(1) a body connection member connected to said instrument body;
(2) an extension member mounting said one of said coil and said magnet; and
(3) said extension member being adjustably movably connected to said body mounting member.

3. The pickup according to claim 2 wherein:
(a) said first mounting means is adjustable whereby said one of said coil and said magnet is movable along a path substantially parallel to or parallel to a tangent of said panel.

4. The pickup according to claim 3 wherein said first mounting means includes:
(a) an outer, tubular guide member;
(b) an inner, reciprocative member telescopically received in said outer member; and
(c) said inner and outer members extending longitudinally in parallel, relation with respect to and spaced from said instrument body panel.

5. The pickup according to claim 2 wherein:
(a) said coil and said magnet are adapted for mounting spaced apart from each other; and
(b) said first mounting means is adjustable whereby said spacing between said coil and said magnet is variable.

6. The pickup according to claim 2 wherein said flux direction means comprises:
(a) a lens forming a concavity receiving said magnet with said first magnet pole oriented away from said concavity; and
(b) said second mounting means mounting said lens on said panel.

7. The pickup according to claim 2 wherein:
(a) said coil comprises first and second concentrically-wound windings.

8. The pickup according to claim 7 wherein:
(a) said first winding comprises an inner winding; and
(b) said second winding comprises an outer winding wound around said first winding.

9. The pickup according to claim 8 wherein:
(a) said windings comprise a continuous length of wire with a respective end of each connected to form one of said coil ends; and
(b) said other coil winding end being located at approximately the middle of said continuous length of wire.

10. The pickup according to claim 9 wherein:
(a) said first and second windings are wound in opposite directions with respect to each other.

11. The pickup according to claim 2 wherein:
(a) said coil includes a diameter and a thickness; and
(b) said coil diameter is a least four times greater than said coil thickness.

12. The pickup according to claim 11 wherein said vibration-damping means comprises:
(a) a resilient member interposed between said instrument body and said coil.

13. The pickup according to claim 2 wherein:
(a) said first mounting means includes vibration-damping means.

14. A pickup for a musical instrument having a hollow body with an interior at least partly enclosed by a panel, which comprises:
(a) an electrical coil with a center, multiple turns and first and second ending points;
(b) a magnet with first and second poles;
(c) first mounting means for attachment to said body and for mounting one of said coil and said magnet within said body interior;
(d) second mounting means for attachment to said musical instrument panel and mounting the other of said coil and said magnet within said body interior with said coil and said magnet flux linked;
(e) said first pole of said magnet being oriented toward and flux-linked with a center of said coil;
(f) flux direction means for directing flux from said second pole of said magnet towards said coil around said coil center; and
(g) said flux direction means comprising a lens forming a concavity receiving said magnet with said first magnet pole oriented away from said concavity.

15. The pickup according to claim 14 wherein said first mounting means includes:
(a) a body connection member connected to said instrument body;
(b) an extension member mounting said one of said coil and said pickup; and
(c) said extension member being adjustably movably connected to said body connection member.

16. A pickup for a musical instrument having a hollow body with an interior at least partly enclosed by a panel, which comprises:
(a) an electrical coil with a center, multiple turns and first and second ending points;
(b) a magnet with first and second poles;
(c) first mounting means for attachment to said body and for mounting one of said coil and said magnet within said body interior;
(d) second mounting means for attachment to said musical instrument panel and mounting the other of said coil and said magnet within said body interior with said coil and said magnet flux linked;
(e) said first pole of said magnet being oriented toward and flux-linked with a center of said coil;
(f) flux direction means for directing flux from said second pole of said magnet towards said coil around said coil center; and
(g) said coil comprising a first, inner winding and a second, outer winding would around said first winding, said windings comprising a continuous length of wire with a respective end of each winding connected to form said first coil ending point, and said second coil ending point being located at approximately the middle of said continuous length of wire.

* * * * *